United States Patent [19]

Focke et al.

[11] Patent Number: 4,938,237

[45] Date of Patent: Jul. 3, 1990

[54] APPARATUS FOR TESTING CIGARETTES AND SEPARATING OUT DEFECTIVE CIGARETTES

[75] Inventors: Heinz Focke; Josef Schulte, both of Verden, Fed. Rep. of Germany

[73] Assignee: Focke & Co. (GmbH & Co.), Verden, Fed. Rep. of Germany

[21] Appl. No.: 236,489

[22] Filed: Aug. 25, 1988

[30] Foreign Application Priority Data

Sep. 2, 1987 [DE] Fed. Rep. of Germany ..... 3729213

[51] Int. Cl.[5] ..... A24C 5/31; A24C 5/345; B07C 5/34

[52] U.S. Cl. ..... 131/282; 209/535; 209/536; 131/908

[58] Field of Search ..... 131/282, 283; 209/535, 209/536, 537

[56] References Cited

FOREIGN PATENT DOCUMENTS

| | | |
|---|---|---|
| 0198282 | 10/1986 | European Pat. Off. . |
| 0401314 | 9/1924 | Fed. Rep. of Germany . |
| 0528448 | 6/1931 | Fed. Rep. of Germany . |
| 1103213 | 3/1961 | Fed. Rep. of Germany . |
| 1103215 | 3/1961 | Fed. Rep. of Germany . |
| 1786543 | 10/1965 | Fed. Rep. of Germany . |
| 2713662 | 11/1978 | Fed. Rep. of Germany . |
| 2108818 | 5/1983 | Fed. Rep. of Germany . |
| 0100537 | 2/1984 | Fed. Rep. of Germany . |
| 3442462 | 4/1986 | Fed. Rep. of Germany . |
| 3609094 | 10/1986 | Fed. Rep. of Germany . |
| 3602428 | 7/1987 | Fed. Rep. of Germany . |
| 2345091 | 10/1977 | France . |
| 2156325 | 10/1985 | United Kingdom . |

*Primary Examiner*—Vincent Millin

*Attorney, Agent, or Firm*—Sughrue, Mion, Zinn, Macpeak & Seas

[57] ABSTRACT

For the testing of cigarettes (11, 11*a*, 11*b*) within a cigarette magazine (10), there is a test unit (21) which is arranged at a distance above magazine shafts (17) or a cigarette store (14) for these. In the test unit (21), the cigarettes run in vertical cigarette rows (24) through a number of test shafts (22) arranged next to one another. Within these, individual cigarettes (11*a*) are fixed by clamping in the region of a clamping plane (37) temporarily, in particular at least for the duration of a test cycle. The cigarettes are tested in the region of a test plane (28) at a distance above the clamping plane (37). The cigarette row (24) is temporarily supported at the bottom, on the outlet side of the test unit (21) by carrying webs (39) or carring fingers (46). During the clamping of cigarettes (11*a*) in the region of the clamping plane (37), the test shafts (22) are opened at the bottom, so that the tested cigarettes can be fed to the cigarette store (14) as a result of their own weight.

12 Claims, 7 Drawing Sheets

Figure 1:
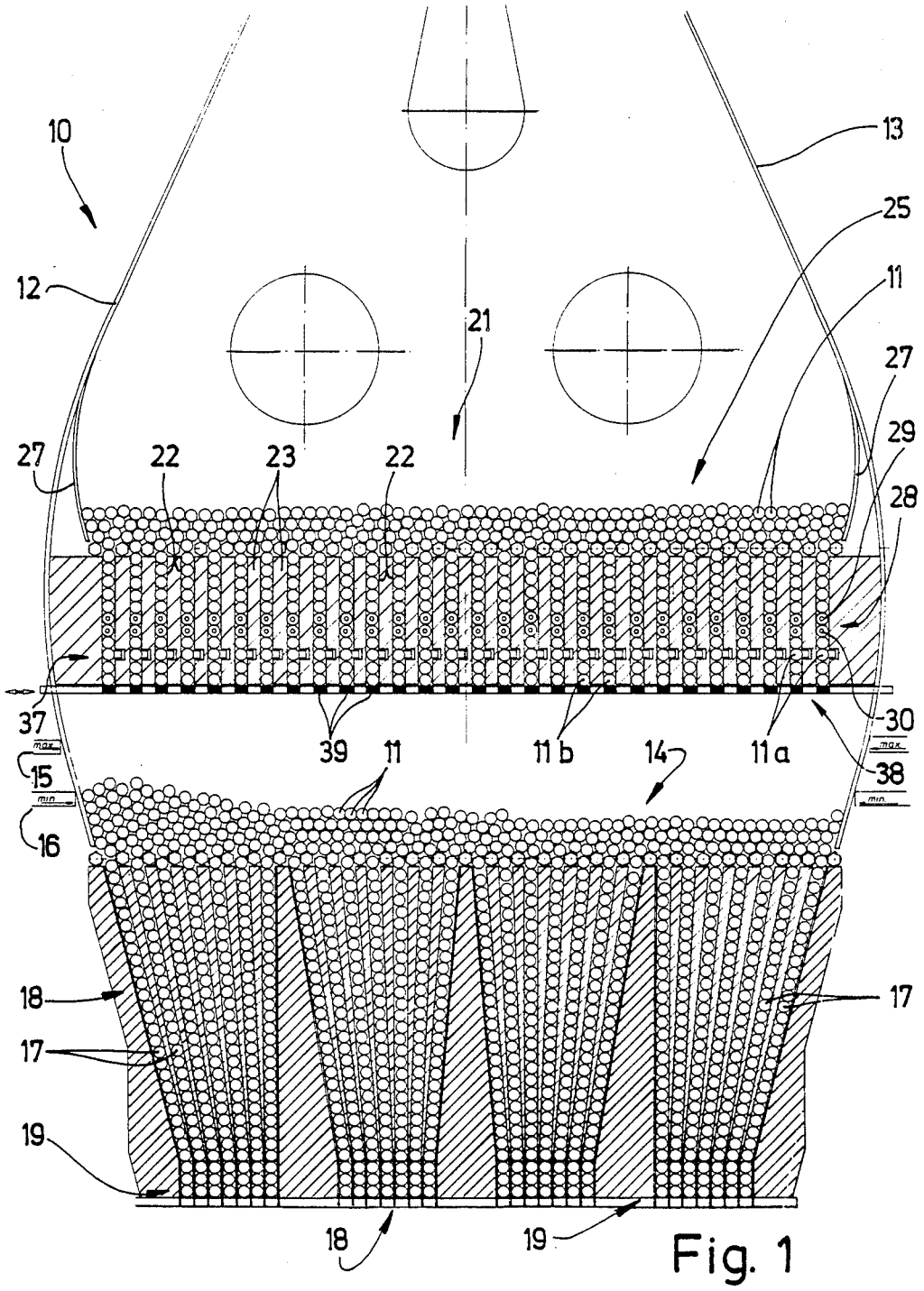

Fig. 7
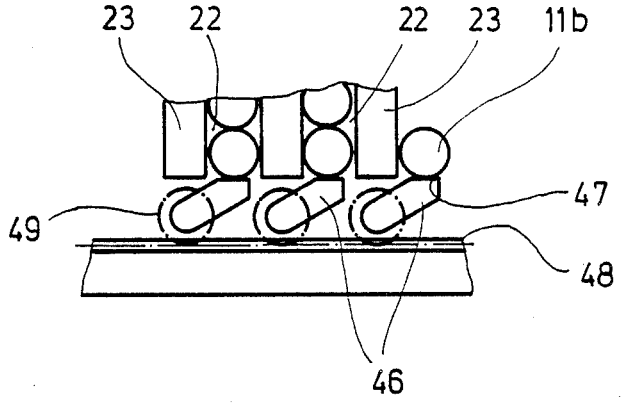
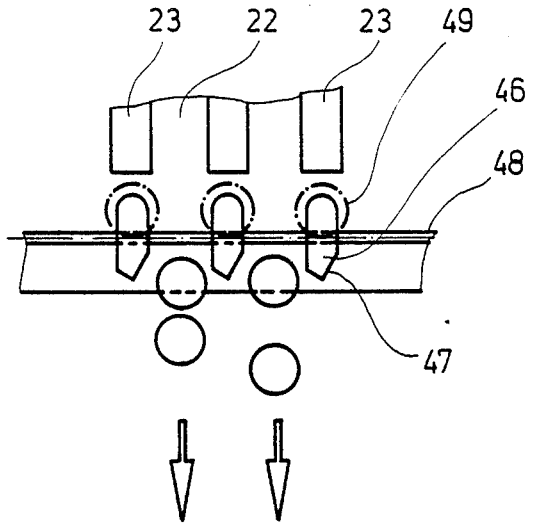
Fig. 8

APPARATUS FOR TESTING CIGARETTES AND SEPARATING OUT DEFECTIVE CIGARETTES

DESCRIPTION

The invention relates to an apparatus for testing cigarettes and separating out any defective cigarettes (faulty cigarettes), with a test zone composed of vertical test shafts arranged next to one another, through which cigarettes are conveyed from the top downwards in vertical cigarette rows and in which the cigarettes are checked in a test plane by testing members, intact cigarettes being transferred downwards to a store.

Before being packaged, cigarettes are normally checked for proper formation. This cigarette test and the separating out of any faulty cigarettes take place within the packaging machine, specifically, in the present invention, in the region of a cigarette store (cigarette magazine). Faulty cigarettes are thereby separated out before cigarette groups are formed for each pack.

It is important, in the cigarette test, to conduct a very accurate test and separate out faulty cigarettes within the shortest possible time, without impairing the further cigarette transport. Also, mechanical stresses exerted on the cigarettes as a result of the test are to be avoided.

To conduct the testing of cigarettes in the region of a test zone within the cigarette magazine or arranged ahead of this, it is necessary to stop cigarettes momentarily in an exact position and then release them again. The object of the invention is to design the test zone so that, for conducting the test, the cigarettes maintain very exact stationary positions despite short cycle times.

To achieve this object, the apparatus according to the invention is characterized in that, in each test shaft, a cigarette can be clamped below the test plane by clamping members at least for the duration of the test.

The cigarettes are tested in the test shafts singly or preferably in pairs, in particular every two cigarettes located one above the other. In order to guarantee their exact test position, a cigarette located underneath these test cigarettes and belonging to the vertical cigarette row is momentarily retained by clamping jaws and then released again.

According to a further feature of the invention, the clamping jaws are designed as elongate clamping fingers which extend parallel to the cigarettes within the test shafts and which are movable transversely for the clamping of the cigarettes. The relatively thin clamping fingers are equipped with curved or similarly designed clamping faces which exert an adjusting effect on the clamped cigarettes.

If two clamping fingers arranged respectively on both sides of a cigarette are provided, the cigarettes are fixed centrally within a test shaft. Alternatively, a clamping finger can be arranged laterally in each test shaft and, as a result of an appropriate transverse movement, retains the cigarette by pressing it against an opposite shaft wall.

According to a further feature of the invention, the clamping fingers of all the test shafts can be actuated jointly, specifically by means of an actuating mechanism extending outside the test shafts and transversely relative to these.

Arranged at the lower outlet ends of the test shafts are holding members for the tested cigarettes, specifically transversely movable carrying webs or pivotable carrying fingers, on which the cigarettes or the cigarette row rest or rests temporarily.

Figure 2:
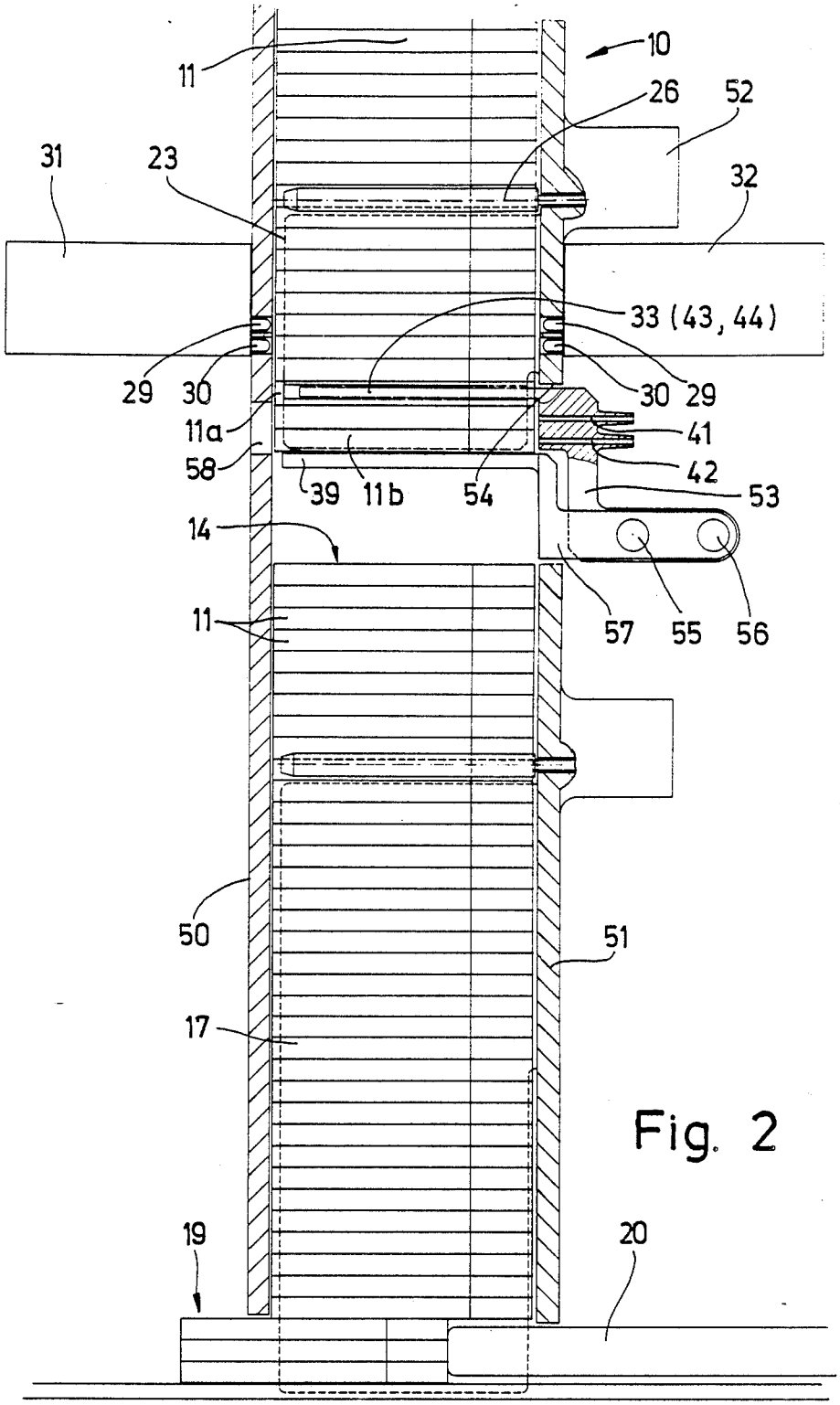
Figure 3:
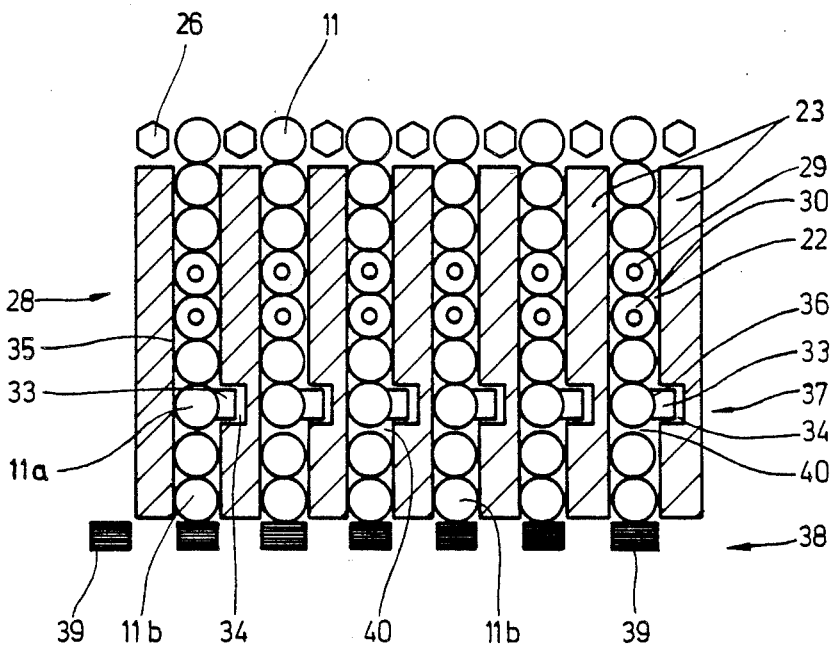
Figure 4:
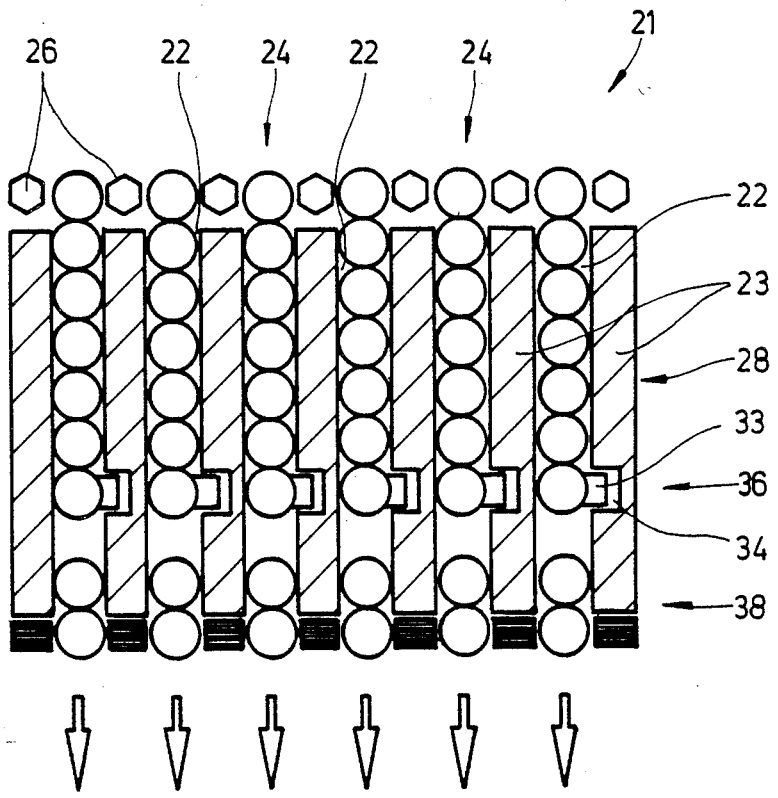
Figure 5:
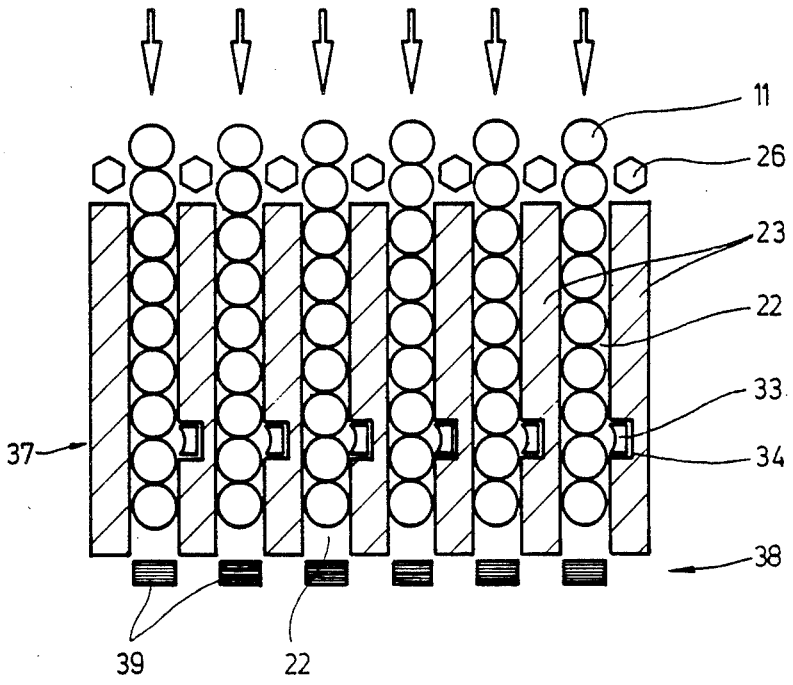
Figure 6:
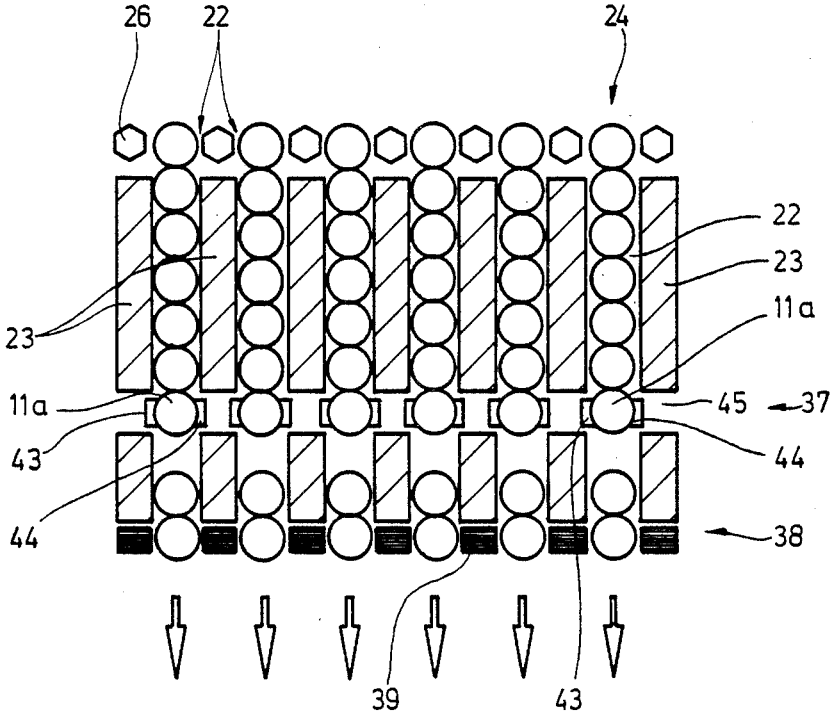

Further features of the invention relate to the design and arrangement of the clamping members and further members of the test zone. An exemplary embodiment of the invention is shown in the drawings. In these:

FIG. 1 shows a cigarette magazine in vertical section,

FIG. 2 shows a vertical section, offset at 90°, through the cigarette magazine according to FIG. 1 and in the region of a test shaft and a magazine shaft, FIG. 3 shows a cutout of a test zone in the cigarette magazine in vertical section on an enlarged scale, FIG. 4 shows the detail according to FIG. 3 in the position for releasing tested cigarettes, FIG. 5 shows the detail according to FIGS. 3 and 4 in the position for the further conveyance of a cigarette row, FIG. 6 shows a detail corresponding to FIGS. 3 to 5 for another embodiment, FIG. 7 shows a detail of the test zone for a further exemplary embodiment, FIG. 8 shows the exemplary embodiment according to FIG. 7, with members in a changed position.

Cigarette packaging machines are conventionally equipped with a cigarette magazine 10. FIG. 1 shows the predominant part of such a cigarette magazine in vertical section, but in a design different from conventional versions. Cigarettes 11 coming from a cigarette production machine or a larger store are introduced at the top into the cigarette magazine 10 equipped with convexly curved side walls 12, 13. A cigarette store 14 is formed inside the cigarette magazine. The level of the cigarette store 14 is monitored by checking members, in particular upper and lower light barriers 15, 16.

The lower region of the cigarette magazine consists of a plurality of vertical or almost vertical magazine shafts 17. The cigarettes 11, as a result of their own weight, run through the magazine shafts 17, at the same time forming rows of individual cigarettes 11 arranged closely one above the other. Several magazine shafts 17, each corresponding to the content of a cigarette pack, are combined into shaft groups 18. At the lower end, cigarette groups 19, each corresponding to the content of a cigarette pack, are ejected from the magazine shafts 17 of a shaft group 18 by ejector members 20 and delivered for packaging.

Within the cigarette magazine 10, in the present case in the region of the largest transverse dimension, a test unit 21 is built in. This is located at a distance above the cigarette store 14. The cigarettes 11 are conveyed through the test unit 21 and checked here. Any faulty cigarettes (insufficient tobacco filling, missing filters etc.) are identified and separated out in the region of the test unit 21. The intact cigarettes are transferred to the cigarette store 14.

In order to conduct the test, the cigarettes are conveyed through vertical test shafts 22 of the test unit 21, specifically as a result of their own weight. The test shafts 22 are divided off from one another by means of parallel vertical shaft walls 23. The dimensions of the test shafts 22 are such that a cigarette row 24 consisting of individual cigarettes arranged closely one above the other is accommodated inside each of them. The cigarette row 24 is moved intermittently through the test shafts 22 from the top downwards. Located above the test unit 21 is a sufficient cigarette collection 25, from which the cigarette rows 24 are formed by means of movable distributor members 26 as a result of the introduction of the cigarettes 11 into the test shafts 22. Arcuate guide plates 27 leading to the test shafts 22 are arranged on the side walls 12, 13.

In the region of the test shafts 22, approximately at mid-height in the exemplary embodiment illustrated, the testing of the cigarettes is carried out in the region of a horizontal test plane 28. In the present case, in each test shaft 22 two cigarettes located one above the other are checked for the correct formation by testing members 29, 30. The cigarettes are grasped for test purposes in the region of their two end faces, in the present case by electro-optical test devices 31, 32. When faulty cigarettes are identified during the check, the test devices 31, 32 transmit a corresponding signal to a cigarette ejector. This is arranged below the test plane 28, specifically in the region of the test unit 22.

For testing the cigarettes 11 within extremely short stationary phases, it is necessary for the end faces of the cigarettes to be aligned approximately centrally with the testing members 29, 30. For this purpose a cigarette 11*a* is fixed at a short distance below the test plane 28 at least for the duration of the test operation. As a result, the cigarettes located above it, especially those in the region of the test plane 28, are aligned exactly in terms of their relative position.

The cigarettes 11*a* in the test shafts 22 are fixed mechanically, specifically by clamping members. In the exemplary embodiment of FIGS. 3, 4 and 5, a clamping member for grasping the cigarette 11*a* is arranged movably in each test shaft 22. In practice, this consists of clamping fingers 33 which extend in the longitudinal direction of the cigarettes over approximately the entire length of these or over the entire depth of the test shaft. The relatively thin clamping finger 33 is arranged laterally next to the cigarettes, specifically in a recess 34 of rectangular cross-section in the shaft walls 23. For grasping a cigarette 11*a*, the clamping finger 33 is moved transversely out of the initial position within the recess 34, until it comes up against the cigarette 11*a* which is pressed by the clamping finger 33 against an opposite side face 35 of the adjacent shaft wall 23 (FIG. 3). The respective clamping position of the cigarette 11*a* is predetermined exactly by the position of the clamping fingers 33. These, on the side facing the cigarettes 11*a*, are designed with a curved clamping face 36 matched to the contour of the cigarettes 11*a*. The design of this clamping face 36 is such that, in the clamping position, the cigarettes 11*a* are aligned centrally with the clamping fingers 33.

The test unit 21 illustrated is aligned for the intermittent testing and conveyance of two cigarettes at a time. For this reason, a clamping plane 37, defined by the clamping fingers 33, is formed at a distance of two cigarettes below the test plane 28.

A further holding plane 38 for the respective bottom cigarette 11*b* of the cigarette row 24 is formed in the region of the test unit 21 or on its lower outlet side. For this purpose, carrying webs 39 for the cigarettes 11*b* are arranged in a plane below the shaft walls 23. These carrying webs 39 are movable to and fro transversely relative to the shaft walls 23, specifically into a supporting or carrying position according to FIG. 3 centrally underneath the test shafts 22 and into a position, opening these, centrally underneath the shaft walls 23 (FIG. 4). The distance between the holding plane 38 or carrying webs 39 and the clamping plane 37 is greater than the multiple diameter of the cigarettes, in the present case somewhat greater than the diameter of two cigarettes located one above the other, so that a small interspace 40 is obtained between the clamped cigarette 11*a* and that located under it. In this region, in particular above the carrying webs 39 and below the clamping plane 37, any faulty cigarettes are pushed out in their longitudinal direction.

The test unit 21 designed in the foregoing way works as follows:

For the alignment of the tested cigarettes, the cigarettes 10*a* are fixed by clamping in the described way in the test position according to FIG. 3. The carrying webs 39 are in the position closing the test shafts 22. The cigarettes located above them and subjected to no load or only slight load can, if they are faulty cigarettes, be ejected during the testing of the cigarettes located above. Faulty cigarettes are ejected by means of blowing nozzles 41, 42 which, located one above the other, are assigned in pairs to each test shaft 22. Depending on the fault signal from the test devices 31, 32, the blowing nozzles 41, 42 can be effective individually or jointly.

After the possible ejection of faulty cigarettes, whilst cigarettes 11*a* continue to be fixed in the clamping plane 37, the carrying webs 39 are moved out of the region of the test shafts 22, so that the tested cigarettes located above them can come out of the test shafts 22 without any faulty cigarettes as a result of their own weight. These intact cigarettes are fed to the cigarette store 14.

The carrying webs 39 are then moved back again into the carrying position underneath the test shafts 22 (FIG. 5). The cigarette 10*a* is released as a result of the backward movement of the clamping fingers 33. The entire cigarette row 24, can now slide downwards within the test shafts 22, until the bottom cigarette 11*b* rests on the carrying webs 39. For the new test cycle, the clamping fingers are then moved transversely again in order to grasp a cigarette 11*a*.

The embodiment according to FIG. 6 differs from the described solution as regards the design of the clamping members. As shown, here, two clamping members, in particular clamping fingers 43, 44 are assigned to each test shaft 22. These are moved up to a cigarette 11*a* on opposite sides, so that it is fixed centrally within the test shaft 22.

Another difference is that the shaft walls 23 are not continuous over the entire height of the test shafts 22, but have an interruption or gap 45. This continuous interspace at the same time defines the clamping plane, within which the clamping fingers 43, 44 are transversely movable.

A further alternative is shown in simplified form in FIGS. 7 and 8. This has a different design of the carrying webs 39. In this exemplary embodiment, pivotable carrying fingers 46 are arranged underneath the shaft walls 23 and are pivoted into the carrying position in such a way that a supporting face 47 located at the end is directed horizontally and serves as a rest for the bottom cigarette 11*b*. The carrying fingers 46 designed as projecting pivoting levers are mounted in a pivot bearing underneath the shaft walls 23 and by means of a gear are pivotable out of a position directed downwards in the extension of the shaft walls 23 (FIG. 8) into the supporting position pointing obliquely upwards according to FIG. 7. In the example illustrated, the carrying fingers 46 are moved with a pivoting effect by means of a common rack 48 via pinions 49 assigned to each carrying finger 46.

The cigarette magazine 10 is equipped with a continuous front wall 50 and a rear wall 51. The test unit 21 and its shaft walls 23 are connected to the rear wall 51, as are further members. Thus, as shown in FIG. 2, the distributor members 26 are mounted rotatably in the rear wall 51 as protruding parts projecting on one side and are movable by means of a drive unit 52.

The clamping fingers 33 and 43, 44 are also parts projecting on one side, in particular reaching from the rear wall 51 into the test shafts 22. In the present exemplary embodiment (FIG. 2), each clamping finger 33 is attached to a holder 53 which, here, is Z-shaped. This is located outside the cigarette magazine 10 in the region of the rear wall 51 and reaches into a continuous orifice 54 in the latter. The holders 53 are mounted displaceably on two horizontal or transversely extending carrying rods 55, 56. As a result of appropriate actuation, all the holders 53 and consequently the clamping fingers 33 are jointly moved transversely, the holders 53 at the same time being displaced on the carrying rods 55, 56.

In a corresponding way, the carrying webs 39 too are mounted on the carrying rods 55, 56 by means of angled or Z-shaped holders 57, specifically in the region between the holders 53 for the clamping fingers 33. The joint transverse movement of the holders 57 together with the carrying webs 39 is executed in the way described.

A further special feature of the exemplary embodiment according to FIG. 2 is that the blowing nozzles 41, 42 are incorporated in the holder 53 for the clamping fingers 33. This ensures that, whenever the clamping fingers 33 are in the clamping position, the blowing nozzles 41, 42 are aligned, below the clamping plane 37, in each case in front of a pair of cigarettes arranged one above the other. An ejection orifice 58 for the outlet of any faulty cigarettes is formed on the side opposite the blowing nozzles 41, 42, in particular in the front wall 50.

I claim:

1. Apparatus for testing cigarettes and separating out any defective cigarettes, with a test zone composed of vertical test shafts arranged next to one another, through which cigarettes are conveyed from the top downwards in vertical cigarette rows and in which the cigarettes are checked in a test plane by testing members, intact cigarettes being transferred downwards to a store, characterized in that, in each test shaft (22), a cigarette (11*b*) is clamped below the test plane (28) by clamping members at least for the duration of the test; and that at least one clamping jaw, in the form of a clamping finger (33; 43, 44) extending in the longitudinal direction of the cigarette (11*b*) next to this, is arranged in each test shaft (22) so as to be transversely displaceable.

2. Apparatus according to claim 2, characterized in that each clamping finger (33), in its initial position, is accommodated in a lateral recess in a shaft wall (23) of the test shaft (22).

3. Apparatus according to claim 1, characterized in that the clamping fingers (33; 43, 44) are designed with especially curved clamping faces (36) centering the cigarette (11*a*).

4. Apparatus according to claim 1, characterized in that clamping members (33; 43, 44) and supporting members (39) reach, as members projecting on one side, from a rear wall (51) of the cigarette magazine (10) into the test shafts (22), all the respective clamping members or supporting members of the test unit (21) being jointly movable.

5. Apparatus for testing cigarettes and separating out any defective cigarettes, with a test zone composed of vertical test shafts arranged next to one another, through which cigarettes are conveyed from the top downwards in vertical cigarette rows and in which the cigarettes are checked in a test plane by testing members, intact cigarettes being transferred downwards to a store, characterized in that, in each test shaft (22), a cigarette (11*b*) is clamped below the test plane (28) by clamping members at least for the duration of the test; and that for clamping, there is provided a laterally arranged clamping finger (33) which presses the cigarettes (11*a*) against an opposite side face (35) of the shaft wall (23).

6. Apparatus for testing cigarettes and separating out any defective cigarettes, with a test zone composed of vertical test shafts arranged next to one another, through which cigarettes are conveyed from the top downwards in vertical cigarette rows and in which the cigarettes are checked in a test plane by testing members, intact cigarettes being transferred downwards to a store, characterized in that, in each test shaft (22), a cigarette (11*b*) is clamped below the test plane (28) by clamping members at least for the duration of the test; and that in each test shaft (22), two clamping fingers (43, 44) are arranged respectively on both sides of a cigarette (11*a*) for grasping the cigarette (11*a*) with a clamping effect centrally within the test shaft (22).

7. Apparatus according to claim 6, characterized in that the two clamping fingers (43, 44) assigned to a test shaft (22) are arranged in the region of a gap (45) in the shaft walls (23).

8. Apparatus for testing cigarettes and separating out any defective cigarettes, with a test zone composed of vertical test shafts arranged next to one another, through which cigarettes are conveyed from the top downwards in vertical cigarette rows and in which the cigarettes are checked in a test plane by testing members, intact cigarettes being transferred downwards to a store, characterized in that, in each test shaft (22), a cigarette (11*b*) is clamped below the test plane (28) by clamping members at least for the duration of the test; and that a clamping plane (37) for the cigarettes (11*b*) which is formed by the clamping members is arranged at a distance below the test plane (28) corresponding to the diameter of two cigarettes.

9. Apparatus according to claim 8, characterized in that the cigarettes (11) or the cigarette row (24) formed in the test shafts (22) are stopped at a distance below the clamping plane (37), as a result of the support of the particular bottom cigarette (11*b*) of the cigarette row (24) on carrying members, the carrying members being movable out of the supporting position for releasing tested cigarettes in the case of cigarettes (11*a*) fixed in the region of the clamping plane (37).

10. Apparatus according to claim 9, characterized in that the supporting members for supporting the cigarette row (24) consist of carrying webs (39) which are assigned to each test shaft (22) and which are movable into a position below the shaft walls (23) in order to open the test shafts (22).

11. Apparatus according to claim 9, characterized in that the supporting members are designed as pivotable carrying fingers (46) which are arranged pivotably below the shaft walls (23) and which in order to open the test shafts (22), are pivotable into a downward-directed position in the extension of the shaft walls (23).

12. Apparatus for testing elongated cigarettes and separating out any defective cigarettes, with a test zone composed of vertical test shafts arranged next to one another, through which cigarettes are conveyed from the top downwards in vertical cigarette rows and in which the cigarettes are checked in a test plane by testing members, intact cigarettes being transferred downwards to a store, characterized in that, in each test shaft (22), a cigarette (11*b*) is clamped below the test plane (28) by clamping members (33) at least for the duration of the test; and that, in each test shaft (22), a cigarette (11*b*) is clamped below the test plane (28) by clamping members which extend in the longitudinal direction of the cigarette (11*b*), and which abut the outer periphery of the cigarette (11*b*) but not an end face thereof.

* * * * *